United States Patent [19]

Jacobsén

[11] Patent Number: 4,982,834

[45] Date of Patent: Jan. 8, 1991

[54] GRIPPING MEANS

[75] Inventor: Kenneth Jacobsén Eksjö, Sweden

[73] Assignee: Wamac AB, Sweden

[21] Appl. No.: 303,157

[22] Filed: Jan. 27, 1989

[30] Foreign Application Priority Data

Jan. 28, 1988 [SE] Sweden ..... 8800269

[51] Int. Cl.[5] ..... B65G 29/00

[52] U.S. Cl. ..... 198/803.7; 198/803.9; 271/82; 271/85

[58] Field of Search ..... 198/803.9, 803.7, 803.8, 198/803.1, 470.1; 294/104, 116; 271/204, 206, 268, 277, 82, 85

[56] References Cited

U.S. PATENT DOCUMENTS

| | | | |
|---|---|---|---|
| 4,039,182 | 8/1977 | Reist et al. . | |
| 4,320,894 | 2/1982 | Reist et al. . | |
| 4,681,213 | 7/1987 | Winiasz | 198/803.9 |
| 4,746,007 | 5/1988 | Houseman | 198/470.1 |
| 4,852,722 | 8/1989 | Houseman | 198/803.7 |

FOREIGN PATENT DOCUMENTS

| | | |
|---|---|---|
| 0241631 | 10/1987 | European Pat. Off. . |
| 644816 | 8/1984 | Switzerland . |

*Primary Examiner*—H. Grant Skaggs
*Assistant Examiner*—Cheryl L. Gastineau
*Attorney, Agent, or Firm*—Ostrolenk, Faber, Gerb & Soffen

[57] ABSTRACT

A gripping system consisting of two jaws (2, 3) pivotable in relation to each other on a shaft (32), the shaft being secured to one jaw (3) and extending through a sleeve (53) secured to the other jaw (2), the shaft having an enlarged section (39) adjacent to and having substantially the same outer diameter as the sleeve (53). A tightly coiled helical spring (70) surrounds both the sleeve (53) and the section (39). One end portion of the spring is freely movable on the enlarged section (39) and can be rotated at least in one direction in relation thereto. The other end of the spring is connected to a roller (4) which is pivotably journalled and can be turned upon peripheral contact with a tread surface arranged at a desired position along the path of the gripping system so that the gripping system opens at a position exactly defined by the tread surface.

4 Claims, 2 Drawing Sheets

GRIPPING MEANS

BACKGROUND OF THE INVENTION

The invention relates to a gripping means with a gripper designed to be carried by a link in a conveyor chain guided in a guide channel and running in an endless path, along which actuating elements cause the gripper to close or open in order to grip or release an object, generally a flat object such as a newspaper or the like, the gripping means comprising members permitting the gripper to close, retaining it in closed position and, upon intervention, permitting it to open.

The invention relates to a gripping means constituting a further development of the gripping means described in EPC application No. 86 850 339.2 (Wamac AB).

The gripper described in the foregoing application comprises, as explained more fully therein, two jaws pivotable in relation to each other about a shaft, one of the jaws being provided with a sleeve which forms a bearing for the shaft which carries the other jaw. The shaft has an enlarged section adjacent to and having substantially the same diameter as the sleeve. A helical spring surrounds both the sleeve and the enlarged shaft section, tightly surrounding the parts in unloaded state. One end of the spring is secured to the shaft and the other end is connected to a cam sleeve loosely surrounding the spring. The cam sleeve has a cam which must be carefully directed with respect to the fixed jaw on the gripping means, i.e. the jaw carried by the conveyor chain, to ensure that it is correctly influenced by a stop along the track designed to open the gripping means. The cam is aligned in this desired position by the end of the spring being secured at a suitable angle on the shaft so that the cam shaft will always return to the same angular position after being influenced. In order to secure the end of the spring to the shaft, the free end portion of the shaft may be made conical and a conical pinch fit used to clamp the springs against the conical shaft section. The sleeve is then tightened by means of a central screw against the shaft in axial direction.

Although the assembly work is time-consuming and expensive in the known gripping means, they do have a number of favourable features. However, they have also been found to have a number of drawbacks in practical operation. If normal care is taken during assembly it has been found in practice that a relatively large number of gripping means have to be replaced when an installation is being tested.

More gripping means have subsequently had to be replaced during trial operation.

Of course, by being more careful during assembly, it would be possible to reduce the number of gripping means which must be replaced, but the costs for this are considerable.

Considerable efforts have been made to eliminate these drawbacks, which result in unsatisfactory functioning of the gripping means or the relatively high costs, i.e. the time required to assemble the gripping means.

BRIEF DESCRIPTION OF THE INVENTION

One object of the invention is thus to provide a gripping means which eliminates or reduces at least some of said drawbacks.

This object is achieved according to the invention by a gripping means based on the type known through EPC 86 850 339.2, but modified by replacing the cam and cam sleeve by a roller, that is to say a roller without any cams or the like, in which the first end of the spring is not secured but is freely movable in relation to the shaft and in which, furthermore, the abutment for the cam arranged in the path of movement of the gripping means is replaced by a tread surface directed at a tangent to the periphery of the roller according to the invention and causing this roller to rotate with respect to the gripping means when the latter passes the tread surface, the spring thereby being untwisted, allowing the jaws to open.

In the known technique it has sometimes been desired to allow, for instance, only alternate gripping means to open at a certain position along the track, defined by an abutment. This is achieved by providing the known cam roller with two cams, displaced half a turn with respect to each other and also displaced in axial direction, the gripping means being designed to fit the alternating shape of the cam roller. The orientation of the spring is therefore critical.

An equivalent effect can be achieved with the gripping means according to the invention by designing the roller with two axially separate sections of different diameters, a tread surface being provided for the larger part of each roller, the different roller sections being oriented differently in consecutive gripping means. However, the means is self-adjusting.

The gripping means according to the invention has proved to have surprising advantages over the known means, despite its apparently slight structural differences. The reason for the operational advantages noted in the gripping means according to the invention is because there is no longer any need to secure the end of the spring. It should be clear that the wire cross section in springs of the type in question is substantially rectangular and the coils are tightly wound in unloaded state, thus giving the spring a cylindrical shape. Depending on the fit between spring and its support, a certain rotation may be permitted between shaft and sleeve after turning the ends of the spring a certain angle, thus increasing the inner diameter of the spring to a sufficient extent. According to known technology it was not always possible to ensure that one end of the spring was secured to the shaft without causing torsional or bending forces in the spring wire. Such forces may cause a change in the angle required for the spring to permit relative rotation between sleeve and shaft. Furthermore, there is a risk of the axial length of the spring being affected during the securing operation. It will thus also be understood that the spring grip will be affected by its axial length, particularly if the ends of the spring are fixed.

These drawbacks are eliminated according to the invention. The invention also includes members, i.e. end rings, which are maintained a predetermined distance apart, corresponding to the axial length of the tightly wound spring, thus preventing any increase in said length due to twisting forces or the like.

It should be remembered that the feature according to the invention of refraining from securing said first end of the spring, i.e. of allowing this part substantially slide on the enlarged shaft section, assumes that the cam and stop used previously are replaced by a roller which is caused to rotate upon passing a tread surface at a tangent to the periphery of the roller. It is only through the latter feature that the angular orientation of the roller in relation to the fixed collet jaw becomes irrelevant, and this in turn means that the other end of the spring can, without inconvenience, assume any angular position when the gripping means is ready to grip an object.

BRIEF DESCRIPTION OF THE DRAWINGS

The invention, defined in the appended claims, will be described in the following by way of example, with reference to the accompanying drawings, wherein

DETAILED DESCRIPTION OF THE PREFERRED EMBODIMENT

It should first be stated that the gripping means according to the invention is of the general type revealed in EPC application No. 86 850 339.2 (the description of which is incorporated herein by reference), and can therefore advantageously be used in conjunction with the chain and chain guide described therein. Said EPC application also adequately describes the basic structure of the gripping means itself and reference is therefore made to this citation if a more detailed explanation is required.

Figure 1:
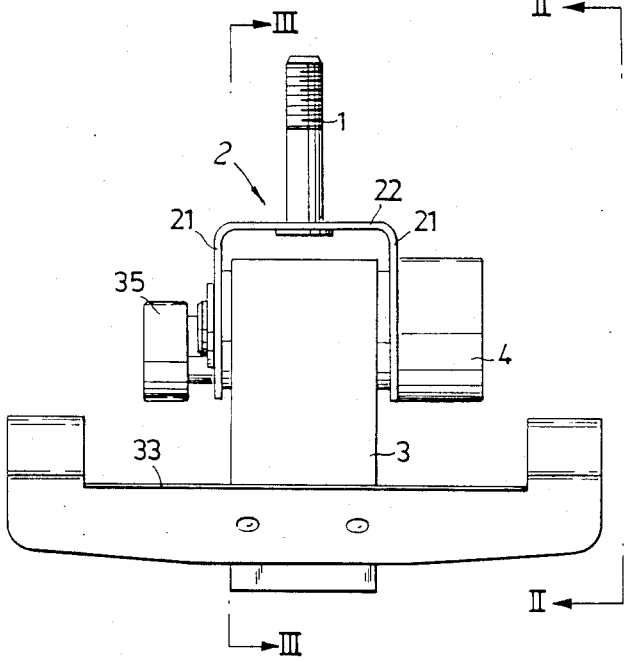
FIG. 1 is a schematic view from the rear of a gripping means according to the invention.
Figure 2:
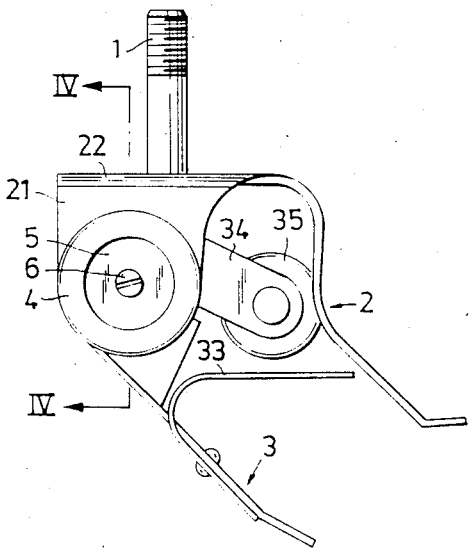
FIG. 2 is a side view taken substantially along the line II—II in FIG. 1.
Figure 3:
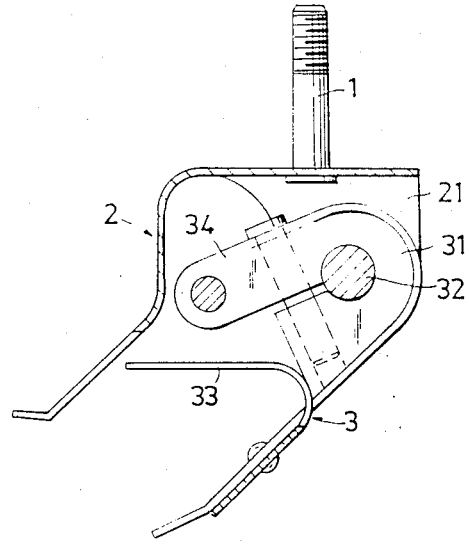
FIG. 3 shows, partly in section a side view taken substantially along the line III—III in FIG. 1.

FIGS. 1–3 show a gripping means designed especially for newspapers, magazines or the like, comprising a bolt 1 for connecting the gripping means to a link in a conveyor chain. The bolt 1 carries a fixed collet jaw 2 which, in the vicinity of the bolt 1, is shaped as a U-shaped yoke with a waist 22 and a pair of shanks 21. A shaft 32 carries the movable collet jaw 3. Towards the outer end of the collet jaw 3 is a U-shaped element 33 which limits entrance of an object such as a newspaper, and adjusts its alignment, before the jaws 2, 3 are closed. The movable collet jaw 3 has a lever 34 with a cylinder 35 cooperating with conventional guide means, not shown, along the track, not shown in detail, to close the gripping means, i.e. to swing the movable jaw 3 towards the fixed jaw 2. On the other side of the jaw 2 from the closing cylinder 35 a cylinder 4 can be seen which is held in place by a washer 5 which is in turn screwed to the end of the shaft 32 by a screw 6.

Figure 4:
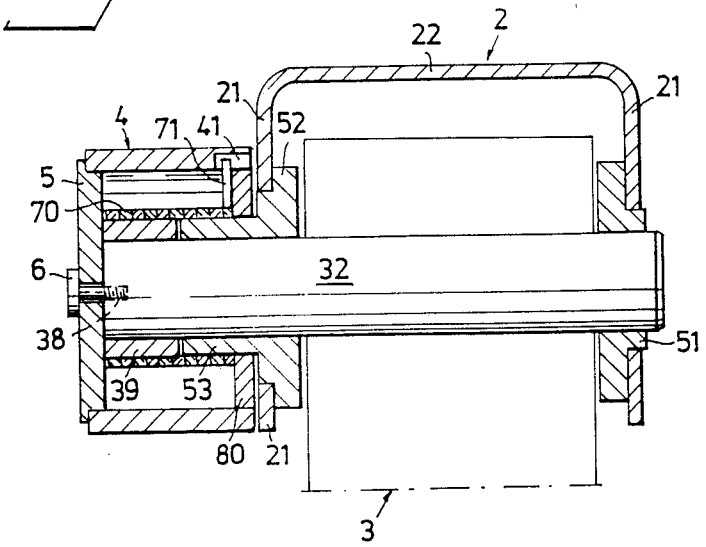
FIG. 4 shows schematically an axial section through the gripping means according to FIG. 1–3.

Considering FIG. 4 it can be seen that bushings 51, 52 are provided on the shanks 21 of the U-shaped yoke portion of fixed collet jaw 2, for supporting the shaft 32. The bushing 52 may have a square cross section at the point where it passes through the shank 21, in order to prevent it from turning relative to jaw 2. The bushing 52 is also provided with a sleeve section 53 extending outside the shank 21. It can also be seen that the shaft 32 has a slightly enlarged end portion 39 (defined by a ring located on the end of shaft 32) located in close contact with the sleeve section 53 and having a slightly larger (but substantially the same) diameter than the sleeve suction 53. A tightly wound helical spring 70 is applied on the cylindrical surface defined by the section 53 and the enlarged end portion 39. The spring 70 is preferably made of wire with rectangular cross section so that the tightly wound turns form a sleeve with substantially smooth inner and outer walls.

The end piece 5 and screw 6 which firmly connects the end piece 5 to the end of the shaft 32, can also be seen.

A ring 80 is also provided on the sleeve section 53, close to the shank 21. The distance between the end plate 5 and the ring 80 is thus well defined.

The periphery of the end plate 5 is provided with a recess providing support for the cylindrical roller 4. The end of the roller 4 adjacent to shank 21 of yoke 2 also rests on the ring 80. The roller 4 is thus firmly supported at both ends. The tubular roller 4 is preferably made of plastic and has suitable clearance to adjacent components, thus enabling it to rotate. The wire end 71 of the spring 70 is bent in a substantially radial direction so that it protrudes radially out past the ring 80 and into a slot 41 in the end of the roller 4 adjacent to the yoke, on the radially inner wall of the roller.

The slot or groove 41 may advantageously offer clearance to the wire end 71 and it will be understood that with the embodiment shown, taking normal care, no disturbing forces need be introduced in the spring via the wire end 71 and its interaction with its surroundings.

It will also be understood that the length of the spring 70 is closer such that it fits the space between the end plate 5 and the ring 80 so that axial extension of the spring 70 is prevented when the gripping means is opened. As mentioned, the spring 70 is preferably wound with a substantially tight contact between adjacent turns.

38 indicates a screw joint between the shaft 32 and screw 6.

It will be understood that with the device shown in FIG. 4 the shaft 32 will be locked against rotation in one direction with respect to the sleeve section 53 (due to frictional forces as the spring 70 tightens against the cylindrical surface defined by enlarged end portion 39 and sleeve section 53), and that the lock will be released by a slight relative turning movement of the roller 4 and thus the spring end 71 (since such movement causes springs 70 to enlarge in diameter and permit rotation of enlarged end portion 39, and therefore shaft 32, relative to spring 70). Since the roller 4 is in practice cylindrical, it will not cooperate with a stop means but rather with a tread surface section in a position along the conveyor track where the gripping means is to be opened. A study of FIGS. 5 and 6 will reveal that this tread surface section may be oriented at a tangent to the passing roller 4 causing it to rotate and untwist the spring 70 so that the gripping means opens.

Figure 5:
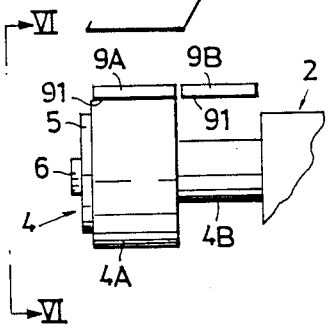
FIG. 5 shows schematically a side view of a cam roller on a gripping means according to the invention which is approaching a stationary tread surface cooperating with the roller to open the gripping means.
Figure 6:
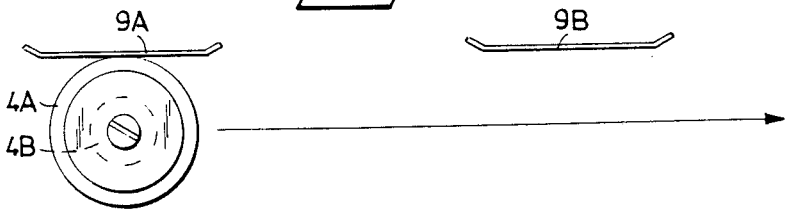
FIG. 6 is a view taken along the line VI—VI in FIG. 5. .

In the embodiment of roller and tread surface shown schematically in FIGS. 5 and 6 the roller is provided with two axially separated sections 4A, 4B of different diameters. The larger of these cooperates with a tread surface section 9A or 9B in order to open the gripping means. In FIG. 5 it can be seen that the tread surface sections are suitably provided with friction material such as a rubber coating 91 on the side which is to form the rolling path for the peripheral surface of the roller. By changing the positions of sections 4A and 4B in alternate gripping means and arranging the tread surface sections 9A and 9B in different positions along the conveyor track for the series of gripping means, alternative means can be opened at the position defined by tread surface section 9A while the remaining gripping means will open at 9B. It is of course also possible to arrange more than two roller sections and more than three tread surface sections corresponding thereto. By arranging the largest tread surface section in a suitable transverse position, the gripping means can be caused to open at respective tread surface sections 9A, 9B arranged in corresponding transverse positions and desired longitudinal positions along the path of the gripping means.

Reference is made to EPC application No. 86 850 339.2 for a general description of the function of gripping means of the pertinent type.

It will be understood that the end of the spring 70 located on the enlarged end portion 39 can rotate thereon in one direction but is locked in the other direction.

When the gripping means is closing, the spring 70 locks against the enlarged end portion 39 of the shaft and slips around the sleeve section 53 of the bushing 52. In closed position the spring 70 prevents the means from opening by locking against both end portion 39 and sleeve section 53.

When the gripping means is opening the spring is untwisted and slides in relation to the sleeve section 53. When performing a large turning movement, (for instance when the opening movement of the gripping jaw is stopped) the spring will also slip around the enlarged end portion 39 of the shaft.

I claim:

1. A gripping means comprising two jaws pivotable in relation to each other on a shaft, said shaft being secured to one of said jaws and extending through a sleeve secured to the other of said jaws, said shaft having an enlarged section adjacent to said sleeve and having substantially the same outer diameter as said sleeve and a helical spring, which externally bridges said sleeve and said enlarged section, the coils of said spring substantially abutting each other, wherein one end portion of said spring is freely movable on said enlarged section and the other end of said spring is connected to a roller which is turnably journalled and is arranged to be turned upon peripheral contact with a tread surface when said roller passes said tread surface.

2. A gripping means as claimed in claim 1, wherein said roller has two axially separate sections of different diameters for cooperating with tread surface sections, the periphery of one of said roller sections having a larger diameter than the periphery of the other of said roller sections and being adapted to cooperate with one of said tread surface sections as said gripping means travels along a path so as to cause said roller to rotate to open said gripping means at a desired position defined by said one of said tread surface sections.

3. A gripping means as claimed in claim 1, wherein said spring is axially enclosed between two end plates which prevent axial expansion of said spring.

4. A gripping means as claimed in claim 2, wherein said spring is axially enclosed between two end plates which prevent axial expansion of said spring.

* * * * *